US009470144B2

(12) United States Patent
Choi et al.

(10) Patent No.: US 9,470,144 B2
(45) Date of Patent: Oct. 18, 2016

(54) VARIABLE COMPRESSION RATIO ENGINE

(71) Applicant: HYUNDAI MOTOR COMPANY, Seoul (KR)

(72) Inventors: Myungsik Choi, Seoul (KR); Won Gyu Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 98 days.

(21) Appl. No.: 14/516,445

(22) Filed: Oct. 16, 2014

(65) Prior Publication Data

US 2015/0101574 A1 Apr. 16, 2015

(30) Foreign Application Priority Data

Oct. 16, 2013 (KR) ..... 10-2013-0123300

(51) Int. Cl.
*F02B 75/04* (2006.01)
*F02D 15/04* (2006.01)

(52) U.S. Cl.
CPC ..... *F02B 75/044* (2013.01); *F02B 75/042* (2013.01); *F02D 15/04* (2013.01)

(58) Field of Classification Search
CPC ..... F02B 75/042; F02B 75/044; F02D 15/04
USPC ..... 123/78 AA, 48 AA
See application file for complete search history.

(56) References Cited

U.S. PATENT DOCUMENTS 1,167,023 A * 1/1916 Schmidt ..... 123/78 AA
2,260,982 A * 10/1941 Walker ..... 123/78 AA
2,769,433 A * 11/1956 Humphreys ..... 123/48 AA
4,241,703 A * 12/1980 Lin-Liaw ..... 123/48 R
7,588,000 B2 * 9/2009 Crower et al. ..... 123/48 AA
2003/0097998 A1 * 5/2003 Gray, Jr. ..... 123/48 AA

FOREIGN PATENT DOCUMENTS

| | | | |
|---|---|---|---|
| JP | 06-010431 | B2 | 2/1994 |
| KR | 10-0130587 | B1 | 11/1997 |
| KR | 10-1998-0050235 | A | 9/1998 |
| KR | 1998-0047819 | U | 9/1998 |
| KR | 10-1998-0074021 | A | 11/1998 |
| KR | 10-2003-0004805 | A | 1/2003 |
| KR | 10-1382318 | B1 | 4/2014 |

* cited by examiner

*Primary Examiner* — Marguerite McMahon
(74) *Attorney, Agent, or Firm* — McDermott Will & Emery LLP

(57) ABSTRACT

A variable compression ratio engine includes a variable chamber housing communicating with a combustion chamber of the variable compression ratio engine. A variable chamber piston is slidably disposed within the variable chamber housing and forms a variable chamber together with the variable chamber housing. A connecting shaft is connected to the variable chamber piston. A hydraulic pressure plunger is connected with the connecting shaft and slidably disposed within the variable chamber housing. A hydraulic pressure chamber is formed, with which oil for absorbing impact is filled together with the variable chamber housing. An oil supplier supplies the oil to the hydraulic pressure chamber. A compression ratio controller is connected to the connecting shaft and controls a relative position of the variable chamber piston.

9 Claims, 3 Drawing Sheets

VARIABLE COMPRESSION RATIO ENGINE

CROSS-REFERENCE TO RELATED APPLICATION

This application claims the benefit of priority to Korean Patent Application No. 10-2013-0123300 filed in the Korean Intellectual Property Office on Oct. 16, 2013, the entire contents of which are incorporated herein by reference.

TECHNICAL FIELD

The present disclosure relates to a variable compression ratio engine. More particularly, the present disclosure relates to a variable compression ratio engine which may absorb combustion impact and improve durability.

BACKGROUND

In general, the compression ratio of an internal combustion engine is represented by the largest volume of a combustion chamber prior to compression and the smallest volume of the combustion chamber after compression during a compression stroke of the internal combustion engine.

The output of the internal combustion engine increases as the compression ratio of the internal combustion engine increases. However, if the compression ratio of the internal combustion engine is too high, such that knocking occurs, the output of the internal combustion engine decreases, and overheating of the internal combustion engine and a failure in a valve or piston of the internal combustion engine and the like occur.

Accordingly, the compression ratio of the internal combustion engine is set to a specific value within an appropriate range prior to the occurrence of knocking. As such, because the air-fuel ratio and output of the internal combustion engine can be improved by properly varying the compression ratio according to the load of the internal combustion engine, various approaches are being proposed to vary the compression ratio of the internal combustion engine.

These approaches for varying the compression ratio of the internal combustion engine in general employ methods that vary the volume of the compression chamber during the compression stroke.

For example, there have been proposed methods that vary the height of the top dead center of a piston during a compression stroke, or increase or decrease the volume of a sub-compression chamber provided in a cylinder head.

Varying the height of the top dead center of the piston tends to make the structure of the internal combustion engine complicated. Therefore, it may be desirable to vary the compression ratio by providing a sub-compression chamber in the cylinder head to make the structure simple and achieve great improvement in air-fuel ratio.

However, since combustion impact in a combustion stroke is directly transmitted to elements of a variable compression ratio device, durability of the elements may be deteriorated.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a variable compression ratio engine having advantages of improving durability, reducing power for operating a device, and enhancing responsiveness by providing a hydraulic pressure chamber for absorbing combustion impact.

According to an aspect of the present inventive concept, a variable compression ratio engine may include a variable chamber housing communicating with a combustion chamber of the engine. A variable chamber piston is slidably disposed within the variable chamber housing, and forms a variable chamber together with the variable chamber housing. A connecting shaft is connected to the variable chamber piston. A hydraulic pressure plunger is connected with the connecting shaft, slildably disposed within the variable chamber housing. A hydraulic pressure chamber, in which oil for absorbing impact is filled, is formed by the hydraulic pressure plunger together with the variable chamber housing. An oil supplier supplies oil to the hydraulic pressure chamber. A compression ratio controller is connected to the connecting shaft and controls a relative position of the variable chamber piston.

A leaking chamber may be formed between the hydraulic pressure plunger and the variable chamber piston. An oil drain line may be formed within the connecting shaft for the oil in the leaking chamber to be exhausted.

An oil hole may be formed in the variable chamber housing. The oil supplier may include a hydraulic pump and an oil control valve selectively supplying the oil received from the hydraulic pump to the hydraulic pressure chamber through the oil hole.

The oil supplier may further include an accumulator for communicating with the oil control valve.

The oil supplier may further include a check valve disposed between the hydraulic pump and the oil control valve.

The compression ratio controller may include a control shaft, an eccentric cam connected to the control shaft, a connecting link connecting the eccentric cam to the connecting shaft, and a driving unit for selectively rotating the control shaft.

The driving unit may include a worm wheel connected to the control shaft, and a drive motor configured to drive a worm engaged with the worm wheel.

The compression ratio controller may include a crank control shaft connected to the connecting shaft, and a driving unit for selectively rotating the crank control shaft.

The driving unit may include a worm wheel connected with the crank control shaft, and a drive motor configured to drive a worm engaged with the worm wheel.

An exemplary variable compression ratio engine according to the present inventive concept may improve durability, reduce power for operating a device, and enhance responsibility by providing a hydraulic pressure chamber for absorbing combustion impact.

DETAILED DESCRIPTION OF THE EMBODIMENTS

Figure 1:
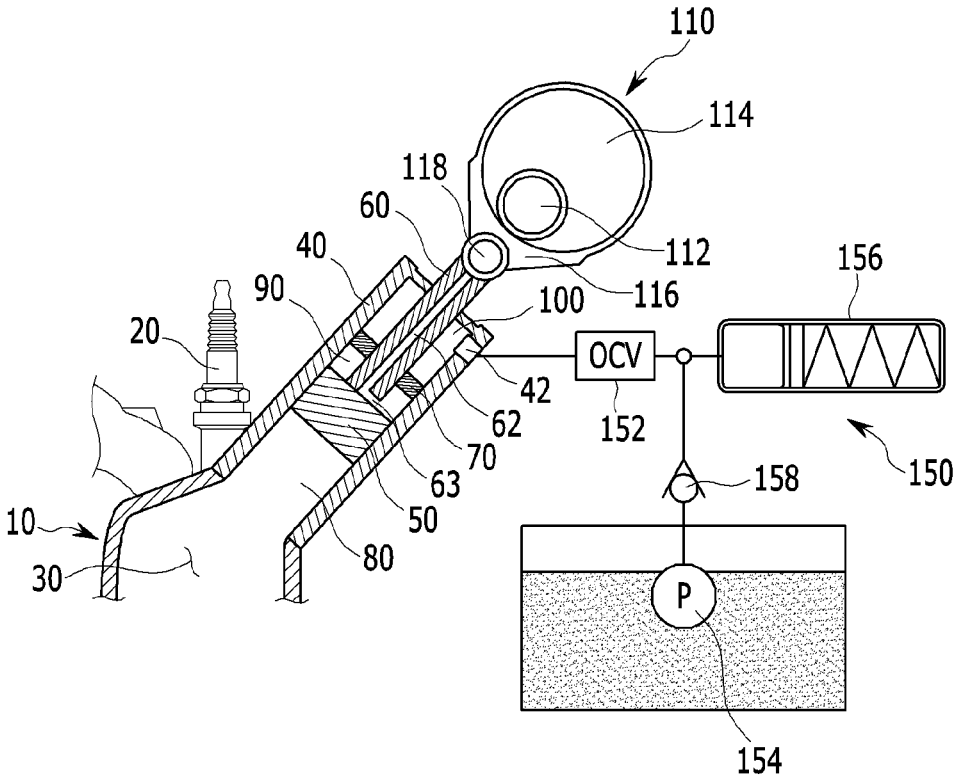
FIG. 1 is a cross-sectional view of an exemplary variable compression ratio engine according to the present inventive concept.

In the following detailed description, only certain exemplary embodiments of the present inventive concept have been shown and described, simply by way of illustration. As those skilled in the art would realize, the described embodiments may be modified in various different ways, all without departing from the spirit or scope of the present disclosure.

Any part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present. In contrast, when an element is referred to as being "directly on" another element, there are no intervening elements present.

Throughout the specification and the claims, unless explicitly described to the contrary, the word "comprise" and variations such as "comprises" or "comprising" will be understood to imply the inclusion of stated elements but not the exclusion of any other elements.

An exemplary embodiment of the present inventive concept will hereinafter be described in detail with reference to the accompanying drawings.

Figure 2:
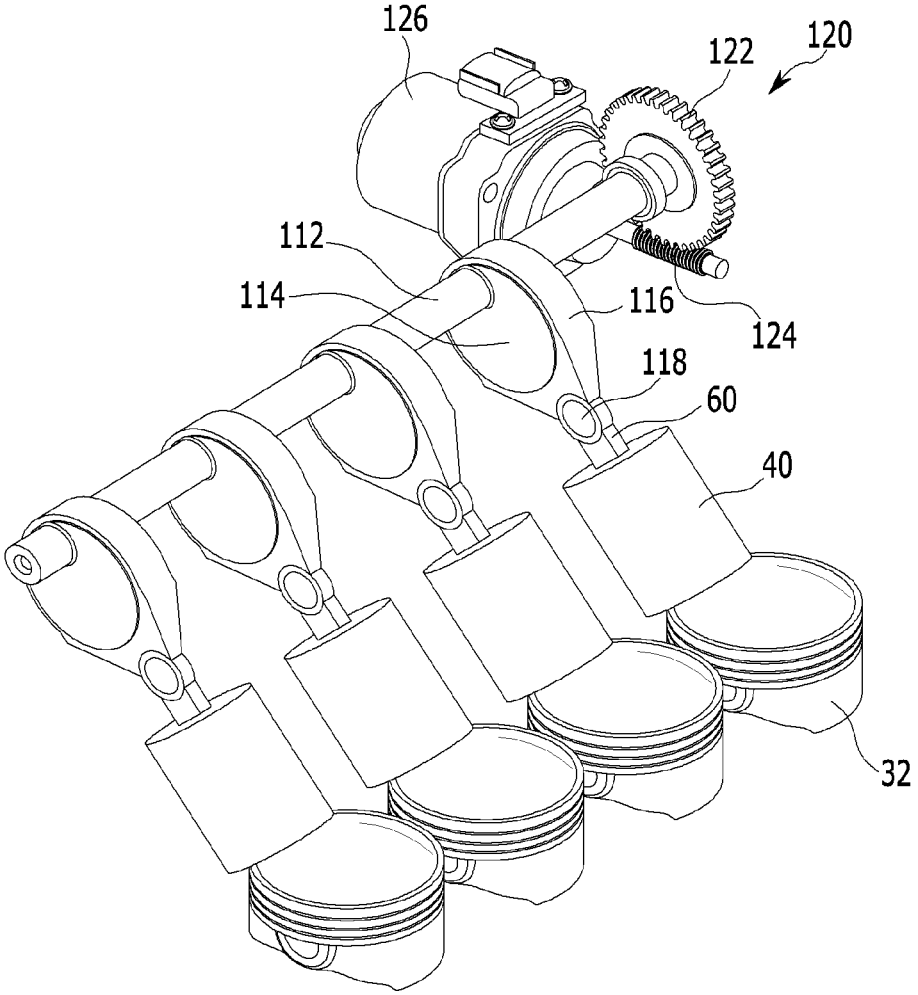
FIG. 2 is a partial perspective view of the exemplary variable compression ratio engine according to the present inventive concept.

FIG. 1 is a cross-sectional view of an exemplary variable compression ratio engine according to the present disclosure, and FIG. 2 is a partial perspective view of the exemplary variable compression ratio engine according to the present disclosure.

Referring to FIGS. 1 2, a variable compression ratio engine 10 includes a variable chamber housing 40 enclosing a combustion chamber 30 of the engine 10, in which a piston 32 reciprocates. A variable chamber piston 50 is slidably disposed within the variable chamber housing 40 and forms a variable chamber 80 together with the variable chamber housing 40. A connecting shaft 60 is connected to the variable chamber piston 50. A hydraulic pressure plunger 70 is connected with the connecting shaft 60 and slildably disposed within the variable chamber housing 40. A hydraulic pressure chamber 100, in which oil for absorbing impact is filled, is formed by the hydraulic pressure plunger 70 together with the variable chamber housing 40. An oil supplier 150 supplies the oil to the hydraulic pressure chamber 100. A compression ratio controller 110 is connected to the connecting shaft 60 and controls a relative position of the variable chamber piston 50. An oil hole 42 is formed in the variable chamber housing 40.

The variable compression ratio engine 10 may be an engine provided with a spark plug 20 and the variable chamber housing 40 and connected to a cylinder head (not indicated), and thus with simple design change may realize the variable compression ratio engine 10.

A leaking chamber 90 is formed between the hydraulic pressure plunger 70 and the variable chamber piston 50, and an oil drain line 62 is formed within the connecting shaft 60 for the oil in the leaking chamber 90 to be exhausted.

The oil supplier 150 includes a hydraulic pump (P) 154 and an oil control valve (OCV) 152 selectively supplying oil received from the hydraulic pump 154 to the hydraulic pressure chamber 100 through the oil hole 42.

The oil supplier 150 may further include an accumulator 156 communicating with the oil control valve 156 and a check valve 158 disposed between the hydraulic pump 154 and the oil control valve 152. The check valve 158 may prevent the oil from flowing backward to the hydraulic pump 154.

The compression ratio controller 110 includes a control shaft 112, an eccentric cam 114 connected with the control shaft 112, a connecting link 116 connecting the eccentric cam 114 with the connecting shaft 60, and a driving unit 120 selectively rotating the control shaft 112. The connecting shaft 60 and the connecting link 116 are connected by a connecting pin 118.

The driving unit 120 includes a worm wheel 122 connected with the control shaft 112 and a drive motor 126 driving a worm 124 engaged with the worm wheel 122.

Referring to FIGS. 1 and 2, operations of the variable compression ratio engine 10 according to an exemplary embodiment of the present inventive concept will be discussed.

According to operating conditions of the engine 10, an engine control unit (ECU, not shown) determines compression ratio.

For example, in a partial load zone, the variable compression ratio engine 10 is operated with high compression ratio for improving fuel consumption and with low compression ratio for enhancing torque in a full load zone.

That is, in the partial load zone, the ECU controls operation of the drive motor 126 for the control shaft 112 to rotate in order for the variable chamber piston 50 to move toward the combustion chamber 30. Then, the volume of the variable chamber 80 is reduced so as to increase the compression ratio of the engine 10, and thus, enhancement of fuel consumption may be realized.

In full load, the ECU controls the operation of the drive motor 126 for the control shaft 112 to rotate in order for the variable chamber piston 50 to move away from the combustion chamber 30. Then, the volume of the variable chamber 80 increases so as to reduce the compression ratio of the engine 10 and to increase the engine torque.

Since the operations of the engine, the ECU, and the like are obvious to a person skill in the art, detailed description will be omitted.

Combustion pressure of the combustion chamber 30 is transmitted to the variable chamber piston 50 and then transmitted to the oil in the hydraulic pressure chamber 100 through the connecting shaft 60. The combustion pressure transmitted to the oil is dispersed to the variable chamber housing 40 and the cylinder head connected to the variable chamber housing 40.

Thus, explosion impact due to combustion of fuel is not transmitted to a specific element but transmitted to entire elements of the engine, and entire durability may be improved.

In this process, oil may partially leak out due to an impact transmitted to the leaking chamber 90. The leaked oil may flow into the combustion chamber 30 to deteriorate fuel consumption, but through the oil drain line 62, the oil may flow to the outside.

If the oil leaks into the leaking chamber 90, the oil stagnates on an upper surface of the variable chamber piston 50, flows into an inlet 63 of the oil drain line 62, and is exhausted outside through between the connecting shaft 60 and the connecting pin 118. Pressure within the leaking chamber 90 is increased due to an explosion impact during combustion, and the pressure may discharge the oil.

When the ECU controls the operation of the compression ratio controller 110 to move the variable chamber piston 50, the ECU also controls operation of the oil control valve 152.

That is, when the compression ratio of the engine 10 is reduced, the oil control valve 152 releases the oil within the hydraulic pressure chamber 100 by the control of the ECU. On the other hand, when the compression ratio of the engine 10 is increased, the oil control valve 152 supplies the oil to the hydraulic pressure chamber 100 by the control of the ECU.

When the oil control valve 152 releases the oil in the hydraulic pressure chamber 100, the oil may be stored in the accumulator 156, and when the oil control valve 152 supplies the oil to the hydraulic pressure chamber 100, the oil stored in the accumulator 156 may be supplied thereto. In this way, supplying and releasing of the oil may be achieved smoothly.

Figure 3:
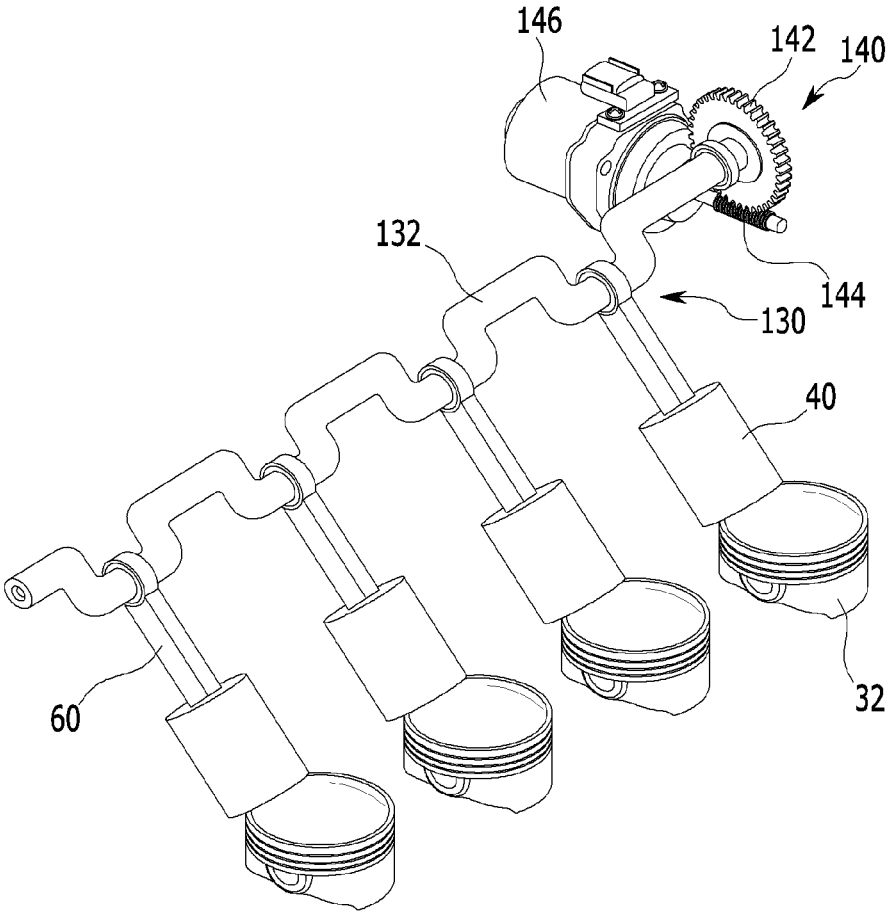
FIG. 3 is a partial perspective view of an exemplary variable compression ratio engine according to the present inventive concept.

FIG. 3 is a partial perspective view of an exemplary variable compression ratio engine according to the present disclosure.

A compression ratio controller 130 of the exemplary variable compression ratio engine according to the present inventive concept may include a crank control shaft 132 connected with the connecting shaft 60. A driving unit 140 selectively rotates the crank control shaft 132.

The driving unit 140 includes a worm wheel 142 connected with the crank control shaft 132 and a drive motor 146 driving a worm 144 engaged with the worm wheel 142.

When the driving unit 140 operates to rotate the crank control shaft 132, a relative position of the variable chamber piston 50 is changed to vary compression ratio of the engine.

The exemplary embodiment of the present inventive concept shown in FIG. 3 is similar to the exemplary embodiment of the present inventive concept shown in FIG. 1 and FIG. 2 except for the compression ratio controller, so that repeated description will be omitted.

While this disclosure has been described in connection with what is presently considered to be practical exemplary embodiments, it is to be understood that the inventive concept is not limited to the disclosed embodiments. On the contrary, it is intended to cover various modifications and equivalent arrangements included within the spirit and scope of the appended claims.

What is claimed is:

1. A variable compression ratio engine comprising:

a variable chamber housing communicating with a combustion chamber of the variable compression ratio engine;

a variable chamber piston slidably disposed within the variable chamber housing, and forming a variable chamber together with the variable chamber housing;

a connecting shaft connected to the variable chamber piston;

a hydraulic pressure plunger connected with the connecting shaft, slildably disposed within the variable chamber housing, the hydraulic pressure plunger, together with the variable chamber housing, forming a hydraulic pressure chamber in which oil for absorbing impact is filled;

an oil supplier for supplying oil to the hydraulic pressure chamber; and a compression ratio controller connected to the connecting shaft and controlling a relative position of the variable chamber piston, wherein a leaking chamber is formed between the hydraulic pressure plunger and the variable chamber piston, and wherein an oil drain line is provided within the connecting shaft for the oil in the leaking chamber flowing into an inlet of the oil drain line to be exhausted.

2. The variable compression ratio engine of claim 1, wherein:

an oil hole is formed in the variable chamber housing;

wherein the oil supplier comprises:

a hydraulic pump; and an oil control valve for selectively supplying the oil received from the hydraulic pump to the hydraulic pressure chamber through the oil hole.

3. The variable compression ratio engine of claim 2, wherein the oil supplier further comprises an accumulator for communicating with the oil control valve.

4. The variable compression ratio engine of claim 2, wherein the oil supplier further comprises a check valve disposed between the hydraulic pump and the oil control valve.

5. The variable compression ratio engine of claim 1, wherein the compression ratio controller comprises:

a control shaft;

an eccentric cam connected to the control shaft;

a connecting link for connecting the eccentric cam to the connecting shaft; and a driving unit for selectively rotating the control shaft.

6. The variable compression ratio engine of claim 5, wherein the driving unit comprises:

a worm wheel connected to the control shaft; and a drive motor configured to drive a worm engaged with the worm wheel.

7. The variable compression ratio engine of claim 1, wherein the compression ratio controller comprises:

a crank control shaft connected to the connecting shaft; and a driving unit for selectively rotating the crank control shaft.

8. The variable compression ratio engine of claim 7, wherein the driving unit comprises:

a worm wheel connected with the crank control shaft; and a drive motor configured to drive a worm engaged with the worm wheel.

9. The variable compression ratio engine of claim 5, wherein the connecting shaft and the connecting link are connected by a connecting pin.

* * * * *